US006491606B1

(12) United States Patent
Swift

(10) Patent No.: US 6,491,606 B1
(45) Date of Patent: Dec. 10, 2002

(54) DEVICE FOR CHANGING PEDAL LOADS ON A SPIN BIKE

(76) Inventor: Paul Swift, 141 Allen, Glendale, CA (US) 91201

( * ) Notice: Subject to any disclaimer, the term of this patent is extended or adjusted under 35 U.S.C. 154(b) by 0 days.

(21) Appl. No.: 09/295,569

(22) Filed: Apr. 21, 1999

(51) Int. Cl.[7] ..... A63B 22/06

(52) U.S. Cl. ..... 482/57; 482/63; 482/65

(58) Field of Search ..... 482/51, 57, 63, 482/65, 64, 110; 188/73, 37, 73.5

(56) References Cited

U.S. PATENT DOCUMENTS 3,833,216 A * 9/1974 Philbin ..... 272/73
4,289,309 A * 9/1981 Hoffman ..... 272/73
4,291,872 A * 9/1981 Brilando et al. ..... 272/73
5,685,806 A * 11/1997 Yu ..... 482/63
5,823,919 A * 10/1998 Eschenbach ..... 482/62
5,961,424 A * 10/1999 Warner et al. ..... 482/63
6,099,440 A * 8/2000 Schurter et al. ..... 482/63

* cited by examiner

*Primary Examiner*—Mickey Yu
*Assistant Examiner*—Tam Nguyen
(74) *Attorney, Agent, or Firm*—Thomas I. Rozsa; Tony D. Chen

(57) ABSTRACT

The present invention is a spin bike pedal load changing means, and foot rest means for use in stationary training, that collectively greatly improves the capabilities of spin bikes over what is currently available in the art. The pedal load changing means allows the calibration of a range of pedal working loads, tailored to the individual rider's capabilities and at the same time can be used as an emergency brake. The foot rest allows for the safe parking of the rider's free leg during one-legged cycling training. The foot rest feature and pedal load change features both effectively increase the performance and safety of the spin bike in use, which is a much-desired feature for health clubs and gyms. The spin bike further allows the instructor to carry out a group class exercise routine, where each rider can set the pedal load changing means on each spin bike to fit their individual strength and stamina capabilities and also allows the rapid changing of pedal load settings to predetermined levels.

9 Claims, 5 Drawing Sheets

DEVICE FOR CHANGING PEDAL LOADS ON A SPIN BIKE

BACKGROUND

1. Field of the Invention

The invention relates to exercise bicycles and in particular to pedal load changing devices for use on stationary exercise bicycles, generally called spin bikes that are used in health clubs, cycle clubs, home environments and the like.

2. Description of Prior Art

Presently there are millions of stationary exercise bikes or spin bikes used in health clubs and exercise clubs around the US and abroad. These bikes were initially developed for use by cyclists who wished to maintain a training schedule even during times when outside weather conditions and/or access to suitable outdoors cycling amenities was not available. For instance, a cyclist who is in training for a race is not always able to ride outdoors, especially at night and so spin bikes were developed to allow training to take place, during these times. These stationary spin bikes are now used both by cyclists and non-cyclists alike, for training and exercise purposes.

These bikes are however, of very basic design and limit the rider in his range of exercise options. The spin bikes supply minimal component adjustments to meet the physical needs of the rider. The spin bikes also use simple adjustment knobs connected to a friction load-generating device mounted on the front wheel, to raise and lower the loads on the pedals. These knobs are turned to change the pedal load and when a number of riders use the bike, each rider has difficulty resetting the pedal load to their own requirements, as there are generally no setting marks on the knob or on the adjacent bike surfaces. Typically many turns of the knob are needed to make a change to the pedal loads, which makes any adjustment difficult during the exercise period.

For this reason, instructors at the clubs with spin bikes have a difficult time coordinating a class of club members on spin bikes as the knobs on these bikes do not allow quick or easy changes of pedal load settings. Because of these limitations in their design, spin bikes do not allow the rider or the instructor to mimic the riding conditions of an outdoors bike or track bike.

As an example, the most popular brand of spin bike has not changed the design of its essential pedal load changing components for many years. Other competitive spin bikes have similar designs and all lack good pedal load changing features which, if present, could greatly improve the spin bike's performance and so meet the needs of a wider variety of users and health club instructors.

In the current art of spin-bikes, pedal loads are varied by turning a control knob, which changes the force on a friction pad or pads on top of, or on the sides of the front wheel, which creates changes in the pedal loads.

In the most common design of spin bike pedal load changing feature, the knob is turned and rotates a threaded rod inside a stationary threaded nut, causing the rod to move up or down. The rod is attached by a cable, or through a set of rotating arms, to two brake pads on either side of the rim of the flywheel. The length of the rod and the flex in the cable attaching it to the attendant pads, combined with the fine thread pitch on the threaded nut, requires the rider to turn the knob a large number of turns, to produce the desired change to the load on the bike pedals. This is an annoyance and does not give the rider the ability to quickly change his pedal loads during a workout.

In some of the more recent models of spin bikes the pedal load changing feature consists of a friction pad mounted on the top of the front wheel rim. Turning the control knob directly raises or lowers a threaded rod, which changes the force on the friction pad. The force is generated by turning the knob inside a square threaded nut, mounted on the spin bike frame. The threaded nut is loosely constrained from turning but can slide up or down within a limited envelope, defined by a square tube mounted on the frame of the spin bike. This sliding feature is used to integrate the emergency brake with the pedal load changing means as follows: When the rider pushes down on the top of the control knob, the entire pedal load changing means slides down and increases the force on the top of the friction pad and so the bike wheel comes to a quick stop.

Also in spin bike training there is a need by many cyclists to do one legged training exercises. This is done to improve their pedal strokes, since cycling on one leg quickly shows up the parts of the pedal stroke that are deficient as it is not masked by the other leg's contribution. A problem arises in finding a suitable and safe place to park the free leg. If held out to the side the rider runs the risk of striking it against the free rotating pedal, and if he elects to park it on part of the frame it pulls his body out of the correct cycling position. There is nothing available in the art, which addresses this problem.

There are a number of spin bike models currently being sold and used but in all cases they are limited in design and operation as described above. Basically the construction and essential features of the pedal load changing features and one legged cycling requirements on spin bikes currently in use, do not meet the physical or training needs of the riders.

There is no known prior art in the field of spin bike design that addresses the problems discussed above. The present invention overcomes these problems and in so doing, also adds new features, which improve the capabilities of a spin bike.

Thus addition of the present invention to a stationary exercise spin bike creates a bike with a good pedal load-changing feature and leg parking capability, which immediately enhances indoor spin bike exercise and training possibilities.

DESCRIPTION OF THE PRESENT INVENTION

The present invention is an advanced design of pedal load changing means and foot parking means not presently available on spin bikes currently in use. These features produce a spin bike that can more closely mimic the operational features of a road bike and also allow for advanced cycling training, using one leg.

The design of the friction device incorporated on the present invention, used to load up the pedals, can be activated about 5 times faster than on standard spin bikes, thus allowing the rider to more rapidly change pedal loads.

The invention includes an up to 10-step, simple pedal load changing means which is based on the following: There is a scale of difficulty known as the Borg Scale, well recognized by the health and fitness training business, which is a scale of perceived exertion for riding a bicycle. The top of the scale is 10 and this represents a load that is almost impossible for the rider to turn the pedals against. The bottom of the scale is 1, which represents a very light pedal load. The pedal load changing means of the present invention mimics the Borg Scale used in general fitness evaluation and adds a very useful exercise feature to a spin bike.

To establish the Borg Scale, using the pedal load changing means on the spin bike incorporating the present invention, the rider gets on the spin bike and starts pedaling. He gradually turns a pressure-adjusting knob, which forces a friction pad downward onto the front wheel rim. This increases the load on the pedals, until he is at the highest load setting that he can handle. This is his number #10 setting. By then simply moving a load change lever down from this #10 setting, the rider can back off from his highest pedal load by increments, all the way down to a very light pedal load, which represents his #1 setting. Note that the scale has now been set up for this individual and his particular abilities, which could of course, be very different for another individual with higher or lower strength and cycling power.

The pedal load change lever has a spring-loaded ball bearing on each side, which fit into a series of holes in the two side plates adjacent to the lever. The rider can then mimic the effect of gear changes on a road bike by pushing the load change lever up or down and feel it slide into the next hole with a sudden resistance, accompanied by an audible 'click'. Thus these clicks can be used to control pedal load settings while the rider is exercising, without distraction.

This pedal load changing system is an essential feature of the present invention, as it allows the individual to set a spin bike's pedal load range to match his or her capabilities. Thus a novice or older person with little body strength, or persons with lighter or heavier body weights, can establish their individual maximum setting for pedal loads as described above. They can then establish up to 10 increments of lower loads by use of the pedal load change lever, and thus stay well within their capabilities. Thus by simply setting the load to the different settings using the pedal load change lever, the person can vary the loads on the pedal and so simulate the variable conditions which are desirable to get a full aerobic workout, yet stay within their own body strength and stamina range.

Another advantage of this pedal load setting invention is that a group of spin bike riders can make adjustments to their individual spin bike pedal loads, to match their individual abilities. Then the instructor can now lead the class through a series of pedal load settings that give the whole class a full workout. No longer does the individual have to fiddle with the turn knob to try and change pedal loads from high to low, while he is pedaling. He can merely reach down and push or pull the load change lever through the desired number of clicks called out by the instructor, which changes pedal resistance and therefore level of workload.

In an exercise class using current state-of-the-art spin bikes, the instructor is severely limited when he tries to get each individual to change the pedal loads in any consistent manner, due to the large number of knob turns required and the absence of an indicator to show knob position. With spin bikes incorporating the present invention, the instructor can now tell the class to "go up 3 clicks"or "go down 6 clicks" and they can all do this very easily and quickly, without much effort or distraction, by activating the pedal load change lever.

Riders with widely different levels of ability can now exercise together and each can get a workout adjusted and tailored to their individual capabilities. This can be done on a group of spin bikes each incorporating the present invention. The pedal load settings can be automatically re-adjusted at the beginning of the workout as the rider's level of ability changes. Or the pedal load change can be made even in the middle of the workout by turning the pedal load change knob up or down which will automatically reset the entire 10-step range, controlled by the lever.

The present invention also incorporates an emergency brake integral with the pedal load change feature, that is activated by a push down thrust of the rider's arm that is a much easier motion for the rider to make, in an emergency situation, when his body is also moving forward after he has lost contact with the pedals. Thus the embodiment described above includes the pedal load changing means and an emergency brake means, both contained in the same assembly and illustrated in FIG. 2*a*.

In the preferred embodiment of the invention, the load change lever can also be used as an emergency brake as follows: When the settings for the load change lever have been established as described above by the rider, the top setting of the lever is the one where the rider can barely turn the pedals and represents a high pedal load and therefore a high friction load on the front wheel. This top setting generates enough load on the front wheel, that in the case of an emergency, when the rider wants to stop the spin bike's rotation, the rider can push the lever forward, which clicks it into higher and higher load settings until the bike's wheel quickly comes to a stop. Thus the pedal load change device can serve both functions, the first to control pedal loads and the second to act as an emergency brake. This preferred embodiment greatly simplifies the design of the embodiment described earlier and allows the same device to function as both pedal load changer and emergency brake as illustrated in FIG. 2*e*.

The spin bike incorporating the present invention also includes a foot rest mounted on the frame of the bike. This foot rest is not available on commercially available spin bikes and so presently when a rider is doing one-leg training he has to hold the other leg out to the side or rear of the bike in an unsupported manner. If he is not careful, he runs the risk of striking his leg against the free rotating pedal of the bike, causing injury. This one-leg pedaling is also used by riders, as part of a training method or to isolate each leg in turn to measure leg strength or when riding on one leg to smooth out the riders pedal stroke.

The foot rest is best located towards the rear of the bike frame, since this is the best position to park a free leg during isolated leg cycling as it does not disrupt the rider's normal pedal stroke or throw the riders body out of balance. A foot rest positioned towards the front of the bike structure upsets the body's position and alignment when used to park a free leg, which is not conducive to good cycling training routines.

As can be seen from the above description, the spin bike incorporating the present invention includes a number of useful features, which together increase the performance, and versatility of spin bikes for use in indoor exercise and training.

DETAILED DESCRIPTION OF THE DRAWINGS

Figure 1:
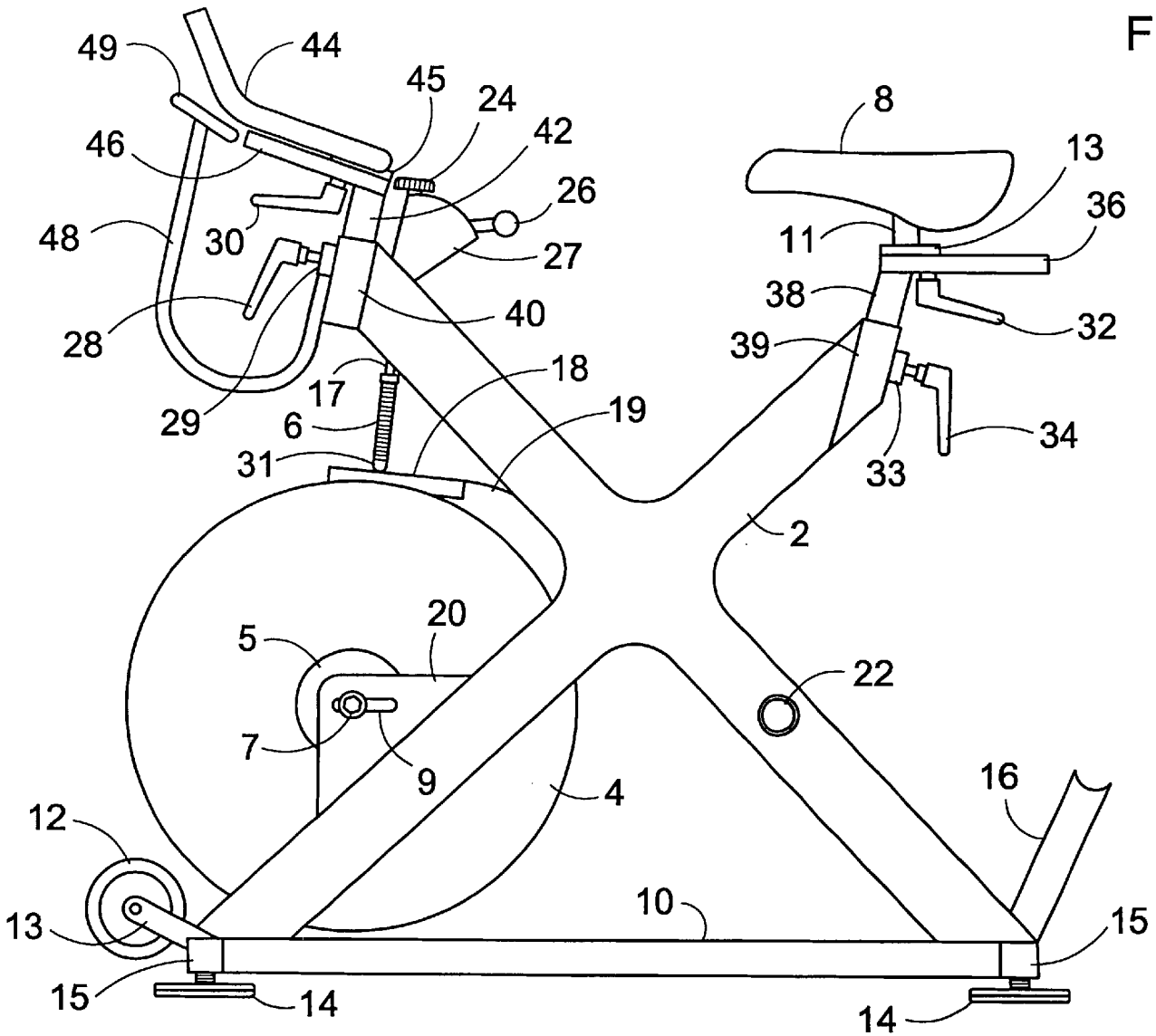
FIG. 1 is a side view of a spin bike incorporating the present invention.

FIG. 1 is a side view of the spin bike incorporating the present invention. The main frame (2) is in the form for instance, of an 'X' shape and is attached to a base frame (10) at the corners of which are four threaded sections (15) connected to four adjustable footpads (14). The foot rest (16) is attached to the main frame (2) at the rear. This foot rest is used when a rider is exercising one leg at a time and a location is needed to 'park' his other leg, out of the way. A small wheel (12) is connected to the base frame (10) through a bracket (13). The front wheel (4) is bolted by a bolt (7), which in turn is connected to a tension adjuster (not shown) on which is screwed an adjustment nut (not shown) and a locking nut (not shown). The tension adjuster is mounted onto the wheel support bracket (20), which in turn is connected to the frame (2). Fore and aft position of the front wheel can be adjusted by moving it backwards and forwards inside the slot (9) on the support bracket (20). The pedal cranks and pedals (not shown) are mounted to the frame (2) through the hole (22). The friction pad (18) sits on top of the front wheel (4) and is connected to the main frame (2) by a spring steel strap (19). Load is placed on the friction pad by turning the knob (24), which pushes down the rod (17) compressing the spring (6) and loading up the acorn nut (31).

The seat is located vertically as follows. The seat vertical adjustment tube (38) is moved inside the frame tube (39) to the correct height. It is then fixed in place by locking the turn handle (34). The threaded section of the turn handle (34) goes through a threaded nut (33) connected to the frame tube (39). The seat (8) is adjustably connected to the main frame (2) as follows. The seat (8) is connected to a vertical support (11), which is rigidly fixed to an adjusting plate (13). The plate (13) slides on top of the locating plate (36), which contains a horizontal slot (not shown). Once the correct position of the seat (8) is found, it is fixed in place by locking the turn handle (32).

The 'bull-horn' handlebars (44) are adjustably attached to the main frame as follows. The handlebars (44) are connected to a handlebar bracket (45) which is attached to a turn handle (30) through a slot (not shown) in an adjusting plate (46). Once the correct horizontal position of the handlebars is found it is locked in place by tightening the turn handle (30). Vertical adjustment of the handlebars is done as follows. The handlebar vertical support tube (42) is raised or lowered by sliding it inside the frame support tube (40), until the correct position is found, then tightening the turn handle (28).

The pedal load change lever (26) is connected to the rod (17) and is locked in position by a hole in the click plate (27). More details of the pedal load change mechanism are shown in FIGS. 2*a* and 2*b*.

Figure 2A:
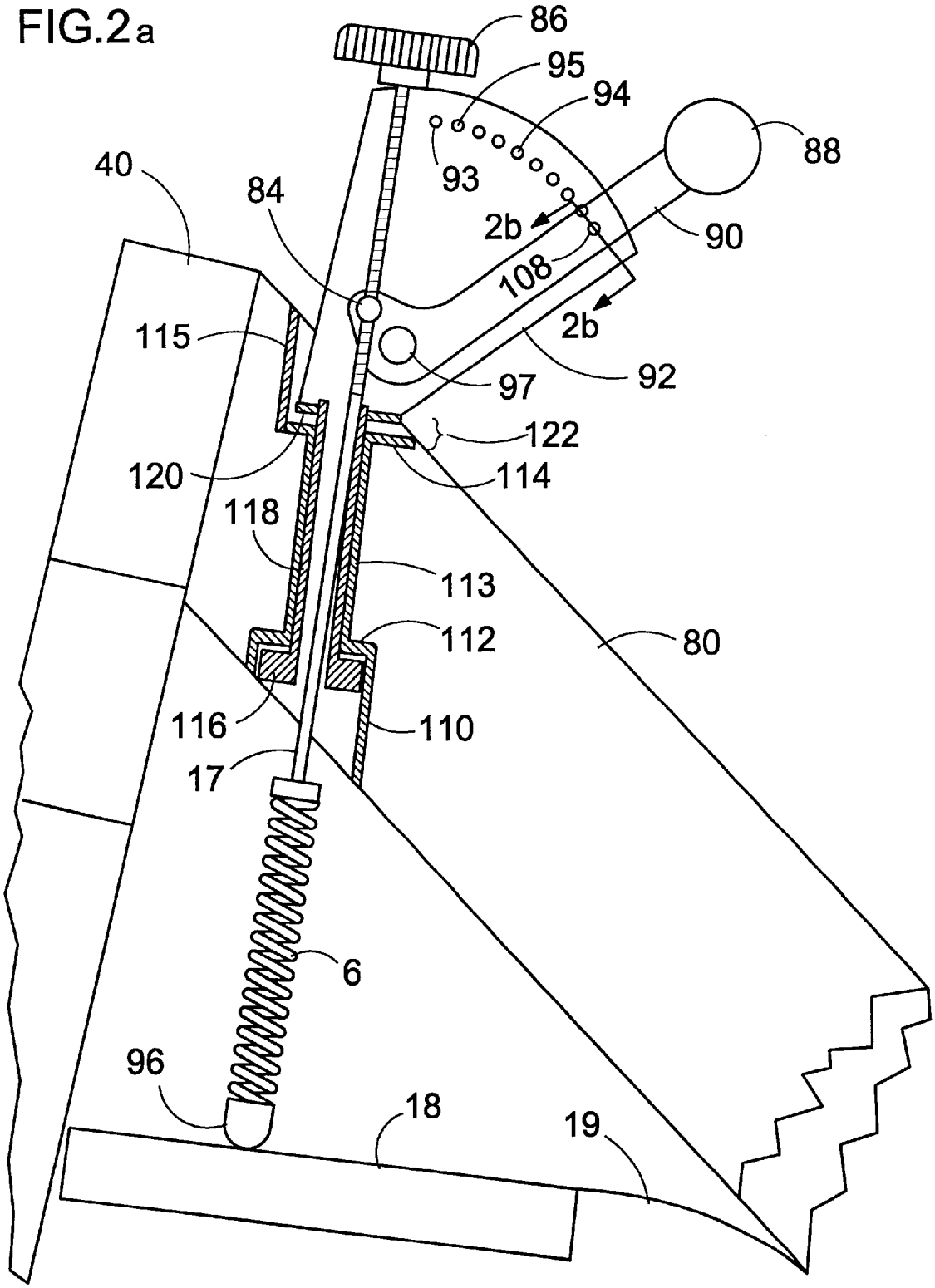
FIG. 2*a* is a cross-section of one embodiment of the pedal load change and emergency brake means.
Figure 2B:
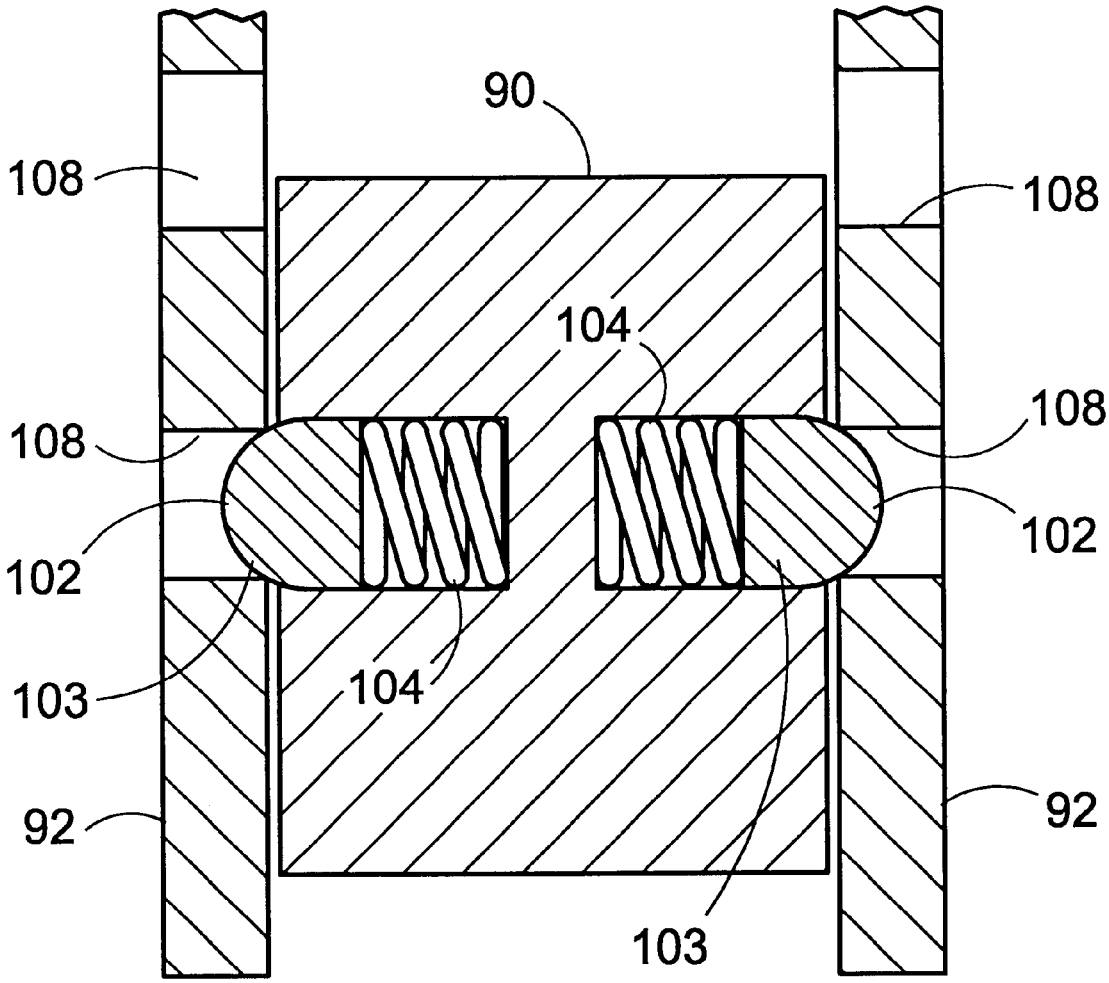
FIG. 2*b* is a cross-section view taken along line 2*b*—2*b* of FIG. 2*A*.

FIG. 2*a* is a cross-sectional view of one embodiment of the pedal load changing means. The turn knob (86) is attached to the top of the threaded screw (17) and passes through the threaded nut (84), which is attached at each end to the two side panels (92). The base of the threaded screw (17) is attached to a compression spring (6), with an acorn nut (96) attached on the other end. The acorn nut presses against the top of the friction pad (18). The side panels (92) contain 10 spaced holes (94) in an arc as shown. Both of the side panels (92) are rigidly attached to a base plate (120) which in turn is rigidly attached to a cylindrical support tube (118). The support tube (118) passes through the center of a cylindrical frame tube (113) and is connected to a square stop washer (116) at the base of the support tube.

The frame tube (113) is connected at the top to a top plate (114), which in turn is attached to a square top frame tube (115). The bottom of the frame tube (113) is connected to a square base plate (112), which in turn is connected to a square base frame tube (110). The assembly of the frame tube (113), top plate (114), square top tube (115), square base plate (112) and base frame tube (110) are rigidly fixed to the frame section (80) of the spin bike. The square shape of the stop washer (116) is held within the base frame tube (110) and cannot rotate. Thus when knob (86) is turned only a vertical motion can occur between the support tube (118) and the frame tube (113), and thus the force on the spring (6) can be varied up and down.

When the turn knob (86) is tightened, the force generated between the acorn nut (96) and the friction pad (18) pushing down on the top surface of the front wheel (not shown), is reacted upwards. This reaction force pushes the entire pedal load control assembly upwards until the top surface of the stop washer (116) contacts the bottom of the square base plate (112). Further turning of the knob will now generate compression loads in the spring and so increase the load on the friction pad (18) and thus increase the pedal load.

The space (122) is used to actuate the emergency brake mechanism. In the case of a need to stop the front wheel quickly, the rider pushes down on the knob (86), which causes the entire pedal load control assembly to slide down inside the frame tube assembly. This downward motion directly increases the load on top of the friction pad (18), no matter what pin engagement position the load control lever (90) is on. Once the knob (86) is let go, the spring force generated by the previous setting of the lever (90) pushes the control assembly up until the stop washer (116) contacts the base plate (112). Once this occurs the sliding motion stops and the rider can continue to cycle at the same settings of pedal loads as before.

The sequence of operation of the pedal load setting is as follows: The load lever (90) is first set at the top position holes (93), then the turn knob is turned pushing the rod (17) down through the threaded nut (84). This increases the load on the friction pad (18) and this vertical load is transferred through the load lever (90) rotating around the locating pin (97) and reacted by the two spring loaded pins embedded in the sides of the load lever (90) and engaged in the position holes (93) as shown in detail in FIG. 2*b*.

A force balancing the vertical force acting on the top of the friction pad (18) is thus created at the top position holes (93), by the locating pins (shown in FIG. 2*b*) which are engaged in the top position holes (93). When the pedal load generated by the friction pad (18) bearing down on the top of the front wheel (not shown) is high enough that the rider can barely turn the pedals, this has established his maximum exercise load. By now pulling the load lever (90) down to the next set of holes (95), the pedal load is decreased and so on, until the lightest load setting at holes (108) is achieved.

A ball shaped element (88) is attached on top of the pedal load lever (90) to make the lever more comfortable for the rider's hand. To better understand how the design of the pedal load change lever works one can now see that the reaction force generated at the top position holes (93) is reduced by the ratio of the linear distance from the center of the threaded nut (84) to the center of rotating pin (97) and the distance from the center of the rotating nut (97) to the top positioning holes (93). As is shown in FIG. 2*b*, this ratio creates a mechanical advantage of about 5:1 that greatly reduces the reaction forces required by the pins in the top locating holes.

FIG. 2*b* is a cross section of the load lever and side panels (92), as shown in FIG. 2*a*. The spring loaded pins (102) are pushed out by the springs (104) and engage in the set of ten holes (93) through (108) shown in FIG. 2*a*. The round shape (102) of the pins (103) is chosen to allow the pins to slip, once the load lever is pulled with sufficient force by the rider, to overcome the spring force generated by the springs (104) at which point the load lever will be able to move to the next set of holes in the side panels (92), with an audible clicking sound.

Figure 2C:
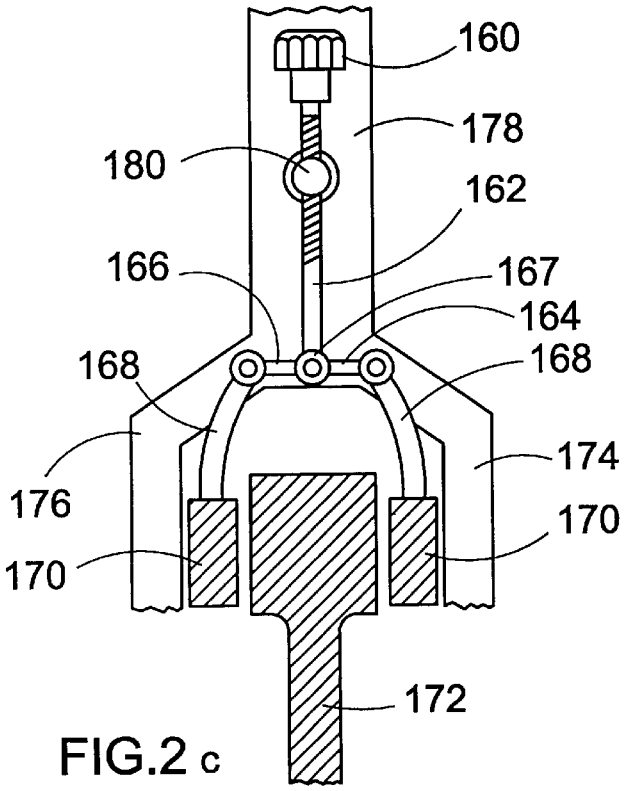
FIG. 2*c* is a front view of the most commonly available pedal load changing means.

FIG. 2*c* is a current state of the art pedal load changing means. The turn knob for changing the pedal load is attached to the top of a threaded rod (162) which passes through a threaded nut (180) which in turn, is fixed to the front frame of the bike (178). The rod (162) is attached at its base to two side arms (164,166), through a rotating coupling (167). The two side arms have rigidly attached extensions (168) which are also rigidly attached to two brake pads (170). When the knob is turned, the threaded rod passes through the threaded nut (180) and thus it pulls up or pushes down on the rotating coupling (167). This rotation in turn moves the brake pads closer to or further away from the sides of the front wheel and thus the pedal load is changed.

Figure 2D:
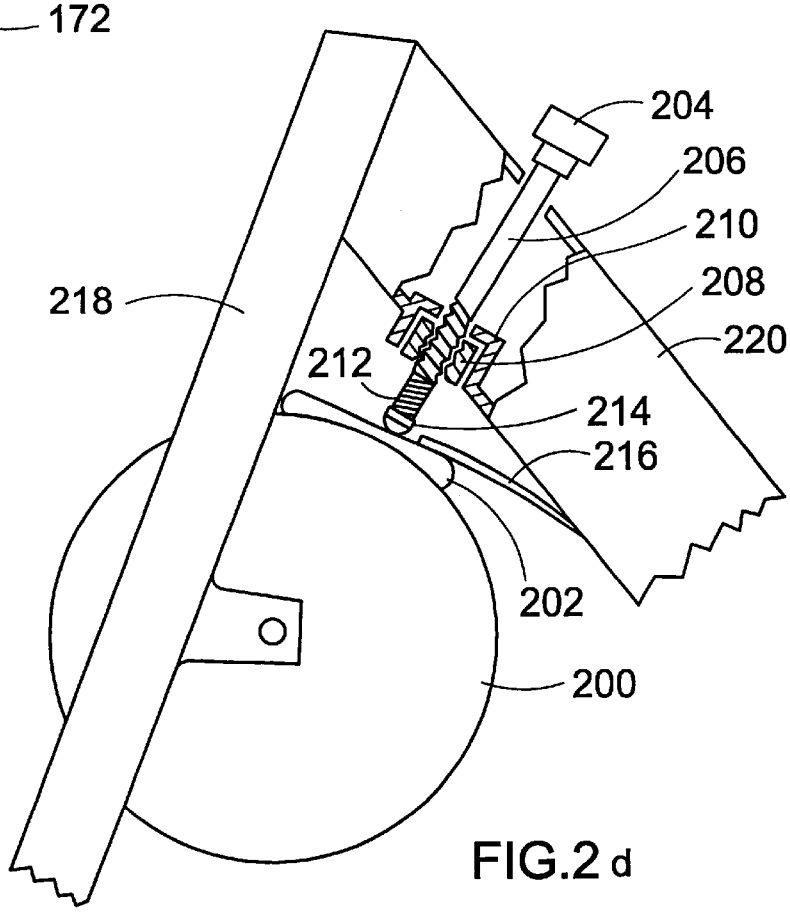
FIG. 2*d* is a front view of the most recent state-of-the-art of combined emergency brake and pedal load changing means.

FIG. 2*d* illustrates a sectional view of the most recent state of the art pedal load change and emergency brake combination means. The pedal load change knob (204) is attached to a threaded rod (206) which threads into a square nut (208). The square nut slides inside a square housing (210) attached rigidly to the main frame tube (220). When the knob (204) is turned, the threaded rod (206) moves downwards and compresses the spring (212), which in turn, pushes on the top of the friction pad (202) positioned on the top of the front wheel (200). The force generated in the friction pad changes the loads on the pedals (not shown). The emergency brake is activated by pushing downwards on the top of the knob (204). This action causes the threaded nut (208) and rod (206) combination to slide down inside the square housing (210) and press on the top of the friction pad (202) directly, thus bringing the front wheel to a stop.

Figure 2E:
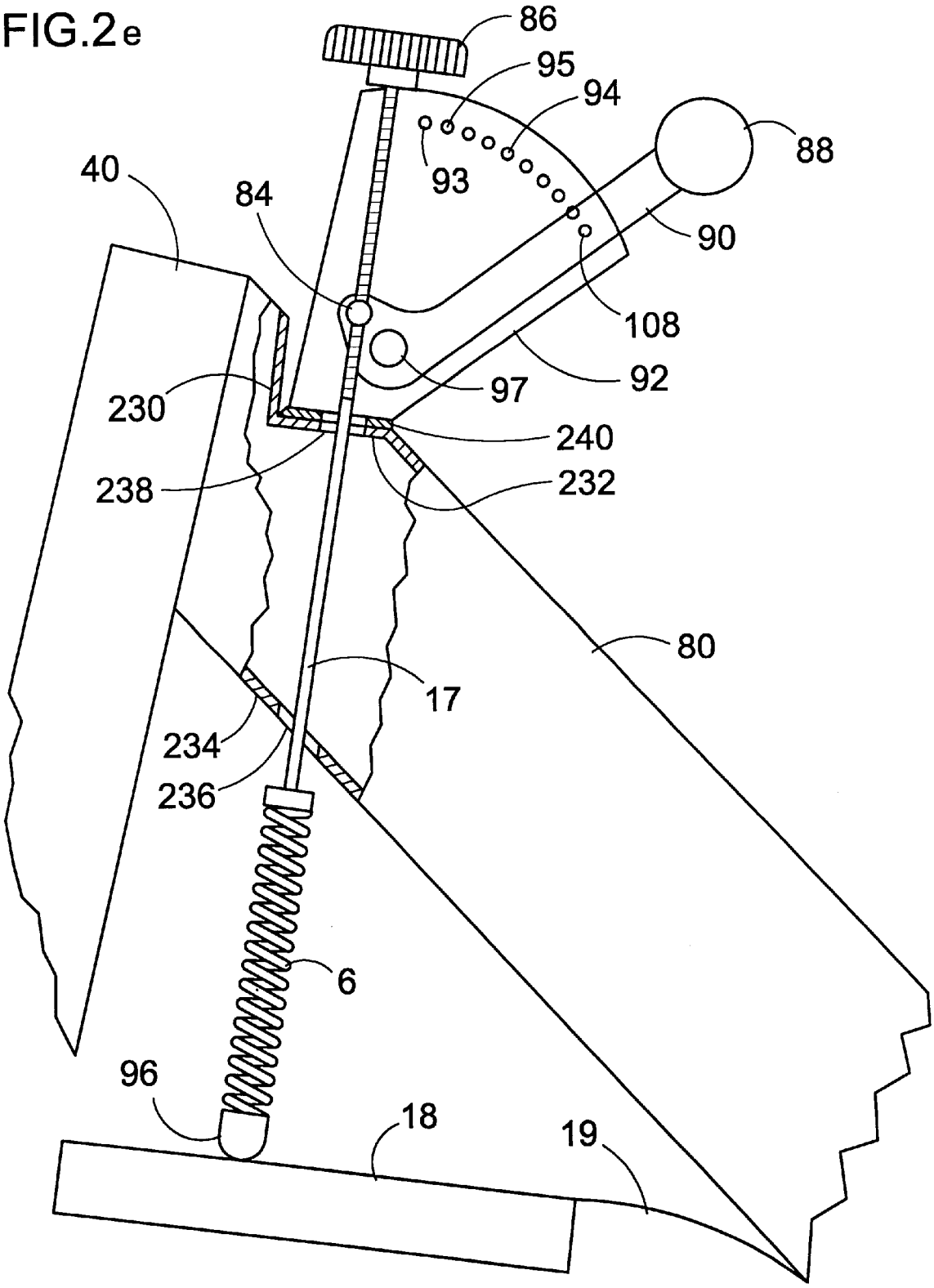
FIG. 2*e* is a cross section of the preferred embodiment of the pedal load change means and emergency brake.

FIG. 2*e* illustrates the preferred embodiment of the combined pedal load change means and the emergency brake mounted on a spin bike. In the design, the turn knob (86) is attached to the threaded rod (17) and passes though a threaded nut (84), attached to the lever (90). The side panel (92) contains 10 holes (93,94,95 for example) into which a pin (not shown) in the lever can engage. With the lever engaged in the top pin hole (93), the knob is turned down, increasing the load on the friction pad (18) this in turn adds load to the front wheel (not shown). This load is reacted by the lever pin, which is engaged in the hole (93). Once the friction load is high enough that the rider can barely turn the pedals, this is the highest of #10 setting. Moving the lever down into holes 95, 94 and so on will pull up on the spring (6) and so reduce the friction pad (18) load, and thus the pedal load is reduced. To act as an emergency brake, the lever is simply pushed back up towards the knob (86) into higher and higher load settings defined by pin hole locations, and the front wheel will then quickly stop. Thus in this preferred embodiment, the two features of pedal load setting and emergency brake are contained within the same device.

OBJECTS AND ADVANTAGES

One object and advantage of the invention is that the emergency brake has a fast response in the downward direction, thus slowing down the front wheel quickly and reducing the chances of injury to the rider.

Another object and advantage of the invention is that the pedal load change mechanism allows much better and faster control, of pedal settings.

Another object and advantage of the invention is that the pedal load change lever allows the instructor to coordinate exercise class instructions to a group of riders with a wide range of physical abilities.

Another object and advantage of the invention is that the pedal load change mechanism allows each rider to set the maximum and minimum pedal loads to his individual optimum settings.

Another object and advantage of the invention is that the adjustable settings of pedal loads allow the rider to set the bike to precisely meet his particular needs.

Another object and advantage of the invention is that the teaching instructor can instruct a group of riders and take them through a workout easily using the pedal load lever clicks.

Another object and advantage of the invention is that a group of riders of widely different capabilities can join together in a workout.

Another object and advantage of the invention is that the emergency brake is activated in the down direction which is much easier for the rider who has to stop suddenly as his body is also moving forward and down.

Another object and advantage of the invention is that the pedal load change mechanism allows each rider to quickly set the maximum and minimum pedal loads for his individual capabilities.

Another object and advantage of the invention is that the teaching instructor can mimic the conditions on a road or track bike by getting the class to move their individual pedal load change levers to various load positions.

Another object and advantage of the invention is that the rider can perform isolated leg training in safety, by parking his other leg on the foot-rest attached towards the rear of the spin bike frame.

Another object and advantage of the invention is that by parking one of the riders legs off the pedal, the rider can quickly develop a feel for the pedal forces generated at all parts of his pedal stroke with each leg.

Another object and advantage of the invention is that by parking one of the rider's legs off the pedal, the rider can find out how much each leg is contributing to his pedaling power.

Another object and advantage of the invention is that by parking one of the rider's legs off the pedal, the rider can correct imbalances of power generated by each leg.

Another object and advantage of the invention is that the pedal load changing lever mechanism can also be used as the emergency brake, simply by pushing the lever into higher and higher settings.

Although the description above contains many specificities, these should not be construed as limiting the scope of the invention but as merely providing illustrations of the presently preferred embodiments of this invention. For example the pedal load changing device can be operated by electrical, hydraulic or pneumatic means rather than a turned knob.

Also the load point settings holes spaced in an arc on the side plates, could be replaced with a toothed or smoothly serrated section into which a spring-loaded rod or bar mounted on the lever, could ride and engage. Also, the integrated emergency braking feature could be designed as a separate distinct feature, and be positioned at some other location on the bike frame.

The foot rest could be a bar or rod protruding from the frame of the bike or it could be a rubber bump for resting the foot or a cup shaped container for locating the toe of the cyclist's shoe, or a platform, as a number of possible examples.

Thus the scope of the invention should be determined by the appended claims and their legal equivalents, rather than by the examples given.

What is claimed is:

1. A spin bike, comprising:

a. a stationary frame assembly having handlebars and seating means;

b. a rotatable wheel mounted on said frame assembly;

c. a pair of pedals located on opposite sides of said stationary frame assembly for rotating said rotatable wheel;

d. a friction pad adapted to engage a portion of said rotatable wheel for placing a load thereon during its rotation;

e. a fine load adjusting mechanism mounted on said stationary frame assembly for varying a fine load applied by said friction pad to said rotatable wheel, the fine load adjusting mechanism having a rotatable knob, a fixed threaded nut, an elongated threaded rod and a compression spring positioned around on the lowermost portion of the threaded rod and biasing said friction pad against said rotatable wheel, the threaded rod having one end connected to the rotatable knob and the other end engaged against said friction pad;

f. an intermediate load adjusting mechanism mounted on said stationary frame assembly and having a pair of spaced apart side panels and a load control lever connected to said fixed threaded nut and located between the pair of side panels, the load control lever movable between a plurality of different intermediate load positions on the pair of side panels for quickly varying an intermediate load applied by said friction pad to said rotatable wheel;

g. means for locking said load control lever to a respective one of said plurality of intermediate load positions as it is moving through said plurality of intermediate load positions, including a pair of spring loaded pin mounted on opposite sides of said load control lever and engageable against said pair of side panels; and h. said intermediate load adjusting mechanism further including means for completely stopping the rotation of said rotatable wheel.

2.The spin bike in accordance with claim 1, further comprising an elevated foot support mounted on said stationary frame assembly to support a rider's foot in a position that maintains the rider's correct body position for cycling on said spin bike.

3. The spin bike in accordance with claim 1, wherein said means for completely stopping the rotation of said rotatable wheel is by pushing upwardly said load control lever.

4. A spin bike, comprising:

a. a stationary frame assembly having handlebars and seating means;

b. a rotatable wheel mounted on said frame assembly;

c. a pair of pedals located on opposite sides of said stationary frame assembly for rotating said rotatable wheel;

d. a friction pad adapted to engage a portion of said rotatable wheel for placing a load thereon during its rotation;

e. a fine load adjusting mechanism mounted on said stationary frame assembly for varying a fine load applied by said friction pad to said rotatable wheel, the fine load adjusting mechanism having a rotatable knob, a fixed threaded nut, an elongated threaded rod and a compression spring positioned around on the lowermost portion of the threaded rod and biasing said friction pad against said rotatable wheel, the threaded rod having one end connected to the rotatable knob and the other end engaged against said friction pad;

f. an intermediate load adjusting mechanism mounted on said stationary frame assembly and having a pair of spaced apart side panels and a load control lever connected to said fixed threaded nut and located between the pair of side panels, the load control lever movable between a plurality of different intermediate load positions on the pair of side panels for quickly varying an intermediate load applied by said friction pad to said rotatable wheel;

g. means for locking said load control lever to a respective one of said plurality of intermediate load positions as it is moving through said plurality of intermediate load positions; and h. said intermediate load adjusting mechanism further including means for completely stopping the rotation of said rotatable wheel; and i. an elevated foot support mounted on said stationary frame assembly to support a rider's foot in a position that maintains the rider's correct body position for cycling on said spin bike.

5. The spin bike in accordance with claim 4, wherein said locking means includes a pair of spring loaded pins mounted on opposite sides of said load control lever and engageable against said pair of side panels.

6. The spin bike in accordance with claim 4, wherein said means for completely stopping the rotation of said rotatable wheel is by pushing upwardly said load control lever.

7. A spin bike, comprising:

a. a stationary frame assembly having handlebars and seating means;

b. a rotatable wheel mounted on said frame assembly;

c. a pair of pedals located on opposite sides of said stationary frame assembly for rotating said rotatable wheel;

d. a friction pad adapted to engage a portion of said rotatable wheel for placing a load thereon during its rotation;

e. a fine load adjusting mechanism mounted on said stationary frame assembly for varying a fine load applied by said friction pad to said rotatable wheel, the fine load adjusting mechanism having a rotatable knob, a fixed threaded nut, an elongated threaded rod and a compression spring positioned around on the lowermost portion of the threaded rod and biasing said friction pad against said rotatable wheel, the threaded rod having one end connected to the rotatable knob and the other end engaged against said friction pad;

f. an intermediate load adjusting mechanism mounted on said stationary frame assembly and having a pair of spaced apart side panels and a load control lever connected to said fixed threaded nut and located between the pair of side panels, the load control lever movable between a plurality of different intermediate load positions on the pair of side panels for quickly varying an intermediate load applied by said friction pad to said rotatable wheel;

g. means for locking said load control lever to a respective one of said plurality of intermediate load positions as it is moving through said plurality of intermediate load positions; and h. said intermediate load adjusting mechanism further including means for completely stopping the rotation of said rotatable wheel, by pushing upwardly said load control lever.

8. The spin bike in accordance with claim 7, wherein said locking means includes a pair of spring loaded pins mounted on opposite sides of said load control lever and engageable against said pair of side panels.

9. The spin bike in accordance with claim 7, further comprising an elevated foot support mounted on said stationary frame assembly to support a rider's foot in a position that maintains the rider's correct body position for cycling on said spin bike.

* * * * *